US005161263A

United States Patent [19]

Geneve et al.

[11] Patent Number: 5,161,263

[45] Date of Patent: Nov. 10, 1992

[54] ARTICULABLE TRAINING TOILET APPARATUS

[75] Inventors: Francois M. Geneve; Luc M. D. Heiligenstein; Stephen B. Melamed, all of Chicago; Carl M. Cohen, Evanston, all of Ill.

[73] Assignee: Sassy, Inc., Northbrook, Ill.

[21] Appl. No.: 696,509

[22] Filed: May 7, 1991

[51] Int. Cl.[5] ..... A47K 11/04

[52] U.S. Cl. ..... 4/483; 4/484; 4/239; 4/DIG. 5

[58] Field of Search ..... 4/239, 479, 480, 483, 4/484, DIG. 5

[56] References Cited

U.S. PATENT DOCUMENTS

| | | | |
|---|---|---|---|
| D. 155,101 | 9/1949 | Muller | 23/296 |
| 777,075 | 12/1904 | Caster | 4/DIG. 5 |
| 1,520,340 | 12/1924 | Nye | 4/239 |
| 1,739,366 | 12/1929 | Lang | 4/239 X |
| 1,855,714 | 4/1932 | Hutchinson et al. | 4/484 |
| 2,127,020 | 8/1938 | Carlson | 4/239 X |
| 2,446,381 | 8/1948 | Middleton | 4/239 |
| 2,500,544 | 3/1950 | Haskins | 4/480 X |
| 2,512,583 | 6/1950 | Roberts | 4/239 |
| 2,662,229 | 12/1953 | Wenkstern | 4/239 |
| 2,682,914 | 7/1954 | Wing | 4/239 X |
| 2,893,017 | 7/1959 | Beck | 4/484 X |
| 2,974,321 | 3/1961 | Salka | 4/484 |
| 3,078,470 | 2/1963 | Rosenfeld | 4/484 |
| 3,235,884 | 2/1966 | Rehsteiner | 4/484 |
| 3,428,967 | 2/1969 | Hughes | 4/484 |

*Primary Examiner*—Henry J. Recla
*Assistant Examiner*—Robert M. Fetsuga
*Attorney, Agent, or Firm*—Dick and Harris

[57] ABSTRACT

An articulable training toilet apparatus for use in cooperation with a supporting toilet seat of a conventional toilet, and which can alternatively be used as a stand alone toilet on independent ground and table surfaces. A seat having an outer peripheral edge and an inner peripheral edge which defines a waste passage aperture, is operably attached to one or more leg members. The leg members are positionable between a fully deployed position, which serve to elevate the seat above a surface so as to enable usage of the appratus as a stand alone toilet, and a fully retracted position which enables the apparatus to be used in operable cooperation with a supporting toilet seat of a conventional toilet. Restraining members are attached to the leg members so as to facilitate aligned and secured cooperation with the conventional supporting toilet seat, when the apparatus is used in association therewith. Locking elements are also provided which serve to prevent the leg members from inadvertent collapse and overextension, when the leg members are in their fully deployed position.

21 Claims, 2 Drawing Sheets

ARTICULABLE TRAINING TOILET APPARATUS

BACKGROUND INVENTION

The present invention relates to children's training toilets, and, more particularly, an articulable training toilet apparatus for use in cooperation with a supporting toilet seat of a conventional toilet, or alternatively, for use as a stand alone toilet on independent ground and table surfaces.

Toilets used for the training of infants have been available for many, many years. Indeed, the prior art discloses children's training toilets for use in cooperation with a supporting toilet seat, as well as others useable as a stand alone unit—some of which provide collapsibility of at least a portion of the overall apparatus. Examples of such prior art devices are: Rehsteiner, U.S. Pat. No. 3,235,884; Roberts, U.S. Pat. No. 2,512,583; and Middleton, U.S. Pat. No. 2,446,381. While Rehsteiner, '884 and Roberts, '583 both disclose partial collapsibility, and more specifically, Rehsteiner, '884 does facilitate collapsibility of its leg portions after use, they are not intended for alternative use in cooperation with either a conventional toilet, or as a stand alone toilet. Other than Middleton, '381, those two prior art references do not facilitate alternative use with a conventional toilet, or, as a stand alone toilet. Furthermore, although alternative use does appear to be capable—although not realistic, in Middleton, '381, Middleton does not provide any form of collapsibility—let alone retraction and deployability of leg members, in which the leg members facilitate alignment and securement of the apparatus with a supporting toilet seat when used in cooperation with a conventional toilet, and which provide elevated lockable support to the apparatus seat when used as a stand alone toilet.

It is thus an object of the present invention to provide an articulable training toilet apparatus which is intended for alternative use with either the supporting toilet seat of a conventional toilet, or, as a stand alone toilet.

It is also an object of the present invention to provide an articulable training toilet apparatus which includes one or more legs which are collapsible and retractable from a fully deployed, elevating and supporting position, to a fully retracted position which facilitates aligned securement between the supporting seat of a conventional toilet, and the articulable training toilet apparatus.

It is still further an object of the present invention to provide an articulable training toilet apparatus which is substantially lightweight, and, compact in size when the one or more legs are in a fully retracted position, so as to facilitate a portable configuration conducive to transporting the apparatus in a small carrying bag, such as a diaper bag.

Another object of the present invention is to provide an articulable training toilet apparatus, which can house and be used in association with, waste collection canisters and/or disposable liners so as to obviate the need for additional cleanup after use.

It is also an object of the present invention to provide an articulable training toilet apparatus which includes lockable legs when the apparatus is used as a stand alone toilet so as to preclude inadvertent collapsing of the legs when a child exerts his or her weight on the apparatus.

These and other objects of the present invention will become apparent in light of the present specification and drawings.

SUMMARY OF THE INVENTION

The present invention comprises an articulable training toilet apparatus for use by a child in cooperation with the supporting toilet seat of a conventional toilet, and alternatively, for use as a stand alone toilet on independent ground and table surfaces.

Seat means are provided for use as a platform upon which a child may sit. The seat means include a top side, a bottom side and an inner peripheral edge which defines an aperture for the passage of human waste therethrough. One or more leg means are operably attached to the seat means for providing elevated support to the seat means when the articulable training toilet apparatus is utilized as a stand alone toilet upon independent surfaces. The one or more leg means include leg relocating means which are used for alternatively deploying and retracting the one or more leg means. Accordingly, the apparatus is used as a stand alone toilet when the one or more leg means are in their fully deployed position (thereby operably elevating the seat means above the independent surfaces), and, it is alternatively used in cooperation with a supporting toilet seat of a conventional toilet when the one or more leg means are in their retracted position (so that either the bottom side of the seat means, or the retracted one or more leg means are adjacent a portion of the top surface of a supporting toilet seat of a conventional toilet). Additionally, the one or more leg means are configured so as to preclude obstruction of the waste passage aperture in the seat means when the one or more leg means are in either one of their alternative deployed and retracted positions.

In the preferred embodiment of the invention, the one or more leg means have a top end and a bottom end, a rear end and a front end, and an inner surface and an outer surface. When the one or more leg means are in their retracted position, they will have their outer surfaces in operable contact with the supporting toilet seat of the conventional toilet—when the apparatus is used in cooperation with the conventional toilet.

Also in the preferred embodiment of the invention, the one or more leg means additionally include restraining means which are operably attached to at least one of the one or more leg means. These restraining means serve to facilitate aligned secured cooperation of the one or more leg means with the supporting toilet seat of the conventional toilet—when the apparatus is used in cooperation with the conventional toilet. Additionally, the restraining means also serve to preclude inadvertent slippage of the articulable training toilet apparatus when used in said operable cooperation with said conventional toilet. It is also contemplated that the restraining means be operably attached to the bottom end of the one or more leg means so as to provide non-slip feet elements which prevent slippage of the apparatus when it is used as a stand alone toilet.

The restraining means may comprise one or more restraining posts which are operably attached to the outer surface of at least one of the one or more leg means. Each of these restraining posts cooperate with the interior periphery of the conventional toilet seat to restrain the position of the apparatus supported thereon. It is also contemplated that the restraining means comprise substantially non-slip pads operably attached to the outer surface of at least one of the one or more leg means for cooperation with the upper surface of the conventional toilet seat, so as to restrain the position of the apparatus supported thereon.

In the preferred embodiment of the invention, the leg relocating means comprises one or more hinge elements located between the one or more leg means and the seat means. Each of the hinge elements have a first section integrally positioned adjacent the outer peripheral edge of the seat means, and a second section positioned adjacent to the top end of the one or more leg means and a shaft element operably and pivotably positioned therebetween. The hinge elements serve to facilitate pivotal movement of each of the one or more leg means relative to the seat means, towards relocation between their deployed and retracted positions.

The hinge elements further include locking means which are used for releasably securing each of the one or more leg means into their deployed position. Accordingly, when the leg means are locked, they will be precluded from collapsing inwardly toward their retracted position when an individual is using the articulable training toilet apparatus as a stand alone toilet, as well as further serving to preclude the one or more leg means from collapsing outwardly during the use by an individual. The locking means comprise one or more notches integrally formed in the inner surface of the one or more leg means, and a locking tab element having a detent at one end, which is formed into the outer peripheral edge of the seat means. The locking tab element springedly engages with the one or more notches upon positioning of the one or more leg means in the deployed position relative to the seat means, so as to substantially restrain the one or more leg means in their deployed position, towards precluding the inward and outward collapse of same.

In the preferred embodiment of the invention, the locking means additionally comprises a portion of the outer peripheral edge of the top side of the seat means directly abutting with a portion of the inner surface of the one or more leg means, proximate the top end of the one or more leg means, when the one or more leg means are in their deployed position. Accordingly, such abutment further precludes the inadventent outward collapse of the one or more leg means when weight is applied to the articulable training toilet apparatus when it is used as a stand alone toilet.

The locking means further comprises the one or more leg means being deployable to a substantially outwardly flared position relative to the outer peripheral edge of the seat means, when the one or more leg means are in their deployed position. Accordingly, such an outwardly flared orientation further serves to preclude the inadvertent inward collapse of the one or more leg means when weight is applied to the articulable training toilet apparatus when it is used as a stand alone toilet.

In the preferred embodiment of the invention, the one or more leg means comprises two leg members. The inner surfaces of each of the two leg members are substantially juxtaposed and parallel to the bottom side of the seat means when the leg members are in their retracted position. Accordingly, when retracted, the outer surface of the leg members will be in substantially horizontal supporting cooperation with the substantially horizontal supporting toilet seat of the conventional toilet. Conversely, when the leg members are pivoted to their fully deployed position, they will be angled outwardly relative to the bottom side of the seat means. Accordingly, such angled positioning serves to operably elevate the bottom side of the seat means above and over the independent surface upon which the articulable training toilet apparatus may be resting, when the apparatus is alternatively used as a stand alone toilet—while further serving to prevent the leg members from collapsing inwardly.

The articulable training toilet apparatus further includes waste retention means removably attachable to the seat means and operably positioned within the waste passage aperture which is defined by the inner peripheral edge of the seat means, for alternatively collecting the human waste released by a child using the articulable training toilet apparatus. The waste retention means comprises a substantially rigid canister which has an open interior region, an interior surface surrounding the interior region, an external surface, a top peripheral edge defining an aperture, and a bottom end which seals the bottom of the open interior region. The waste retention means are operably and telescopically received at the inner peripheral edge of the seat means for alternative affixation and removal therefrom.

In a preferred embodiment of the invention, the articulable training toilet apparatus further includes disposable liner means which are operably positionable within the interior region of the canister. The liner means substantially reduces the likelihood of human waste from physically contacting the interior region of the canister. Furthermore, the disposable liner means have a substantially elastomeric top portion which enables a stretch fit of the disposable liner means over and about the top peripheral edge of the canister.

Liner retaining means are additionally provided for cooperation with the liner means. The liner retaining means, which has a ring-like configuration, is removably attachable to the upper interior edge of the canister. Removal of the retainer ring is facilitated by liner retainer removal means which are integrally positioned within the top inner peripheral edge of the seat means. The liner retainer removal means comprises a grooved finger insertion region immediately proximate both the inner peripheral edge at the top of the seat means, and the outer edge of the liner retaining means.

In the preferred embodiment of the invention, the articulable training toilet apparatus further includes disposable liner means which are used for alternative acceptance of the human waste passing through the aperture in the seat means, and, retaining means which are removably attached to the seat means, for operable cooperation with, and securement of, the disposable liner means.

Also in the preferred embodiment of the invention, the articulable training toilet apparatus further includes urine deflector mean which are operably attachable adjacent the forwardmost position of the human waste aperture of the seat means, for preventing the inadventent spray of urine during use of the articulable training toilet apparatus. The urine deflector means is slidably and telescopically removable from the liner retaining means, towards the bottom side of the seat means, so as to preclude injury which may otherwise occur to an individual contacting the urine deflector means from above.

Additionally, the articulable training toilet apparatus further includes a back side which describes liner storage means which are operably positioned therewithin, for releasably maintaining disposable toilet liners prior to actual use. The liner storage means includes a grooved slot which is used for accepting a person's finger to facilitate removal of the disposable toilet liners.

DETAILED DESCRIPTION OF THE DRAWINGS

Figure 1:
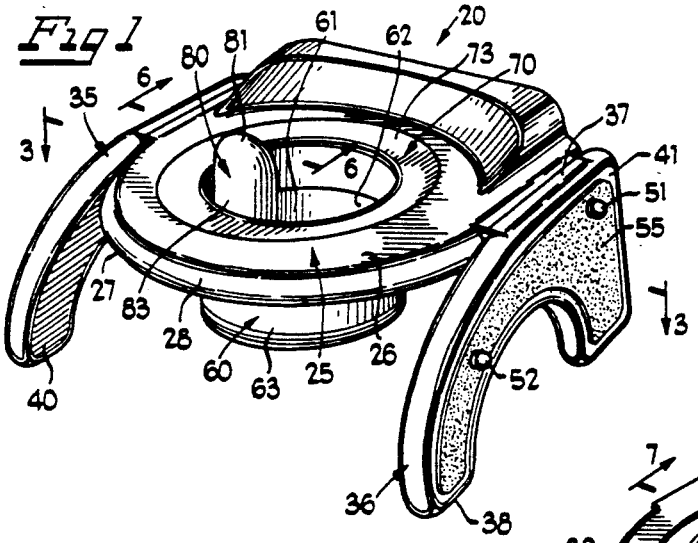
FIG. 1 of the drawings is a perspective view of the present articulable training toilet apparatus showing, in particular, the legs means in their fully deployed position, so as to facilitate use of the apparatus as a stand alone toilet, as well as showing the operable attachment of the canister, retaining ring and urine deflector, together with restraining posts and pads positioned on the outer surface of the leg means.

While this invention is susceptible of embodiment in many different forms, there is shown in the drawings and will herein be described in detail, one specific embodiment with the understanding that the present disclosure is to be considered as as exemplification of the principles of the invention and is not intended to limit the invention to the embodiments illustrated.

Figure 2:
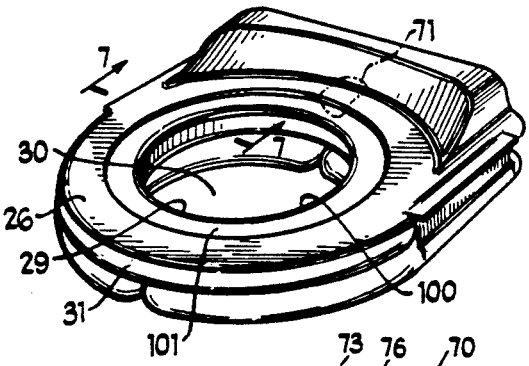
FIG. 2 of the drawings is a perspective view of the articulable training toilet apparatus showing, in particular, the legs means in their fully retracted position, for use in association with a supporting toilet seat of a conventional toilet, and the unobstructed waste passage aperture through both the seat and leg means, while the legs are in their retracted position.
Figure 6:
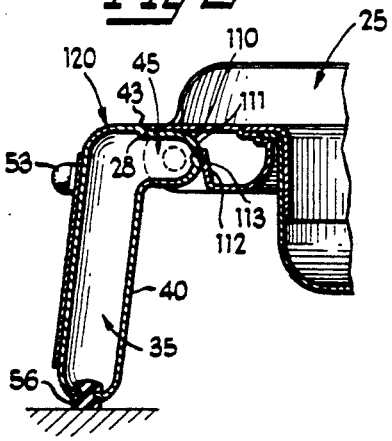
FIG. 6 of the drawings is a partial elevated cross-sectional view of the articulable training toilet apparatus taken along lines 6—6 of FIG. 1, and looking in the direction of the arrows, showing, in particular, the seat locking tab in locked-biased cooperation with the notched portion of the inner surface of the leg means, the outwardly flared positioning of the leg means in its fully deployed position, as well as locking abutment of the outer-upper peripheral edge of the seat means with the upper inner surface of the leg means, for preventing over extension of the leg means and reinforcing apparatus integrity thereat.
Figure 11:
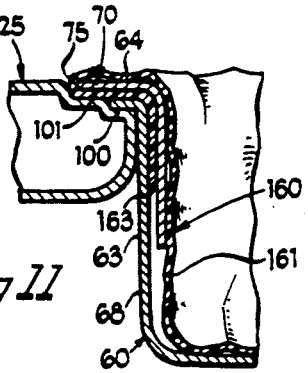
FIG. 11 of the drawings is an enlarged cross-sectional view of the articulable training toilet apparatus showing, in particular, the operable positioning of the disposable liner means when used in cooperation with both the retaining ring and canister.
Figure 3:
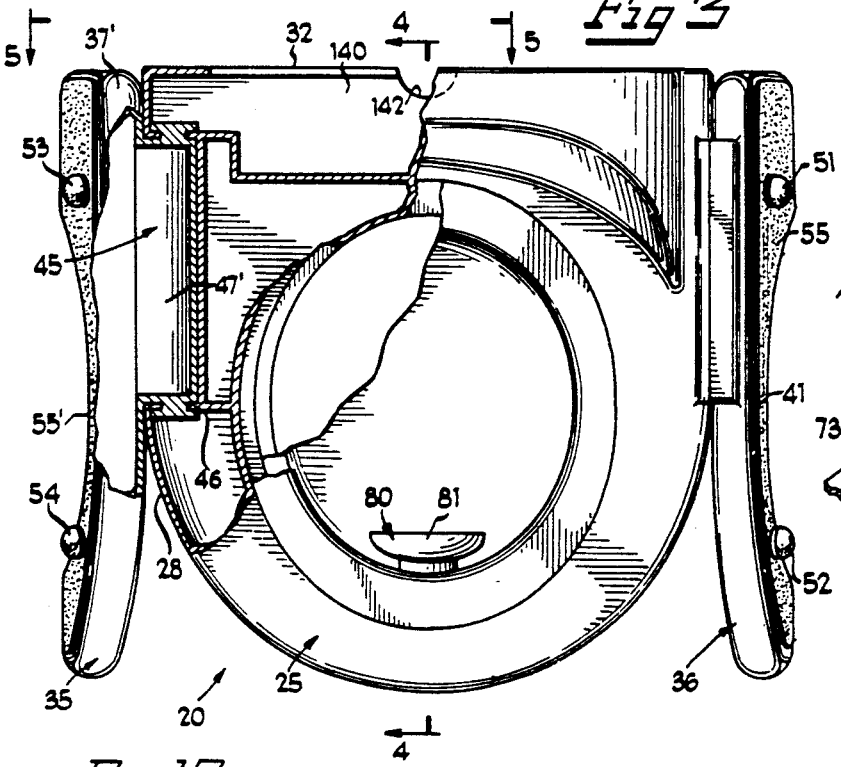
FIG. 3 of the drawings is a top plan view of the articulable training toilet apparatus, in partial phantom and cross-section, showing, in particular, the relative positioning of the canister and retaining rings on the seat means and the hinged pivoting relationship of the leg means relative to the seat for movement between the retracted and deployed leg positions.

Articulable training toilet apparatus 20 is shown in FIGS. 1 and 2 as including, seat means 25 leg means 35 and 36, leg relocating means 45 (as shown in FIGS. 3 and 6) restraining means, such as restraining means 51, 52 and 55 operably attached to leg means 36, waste retention means 60, ring-like retaining means 70, and urine deflector 80. Optional retaining ring removal groove 71 (shown in dashed lines in FIG. 2) is used to facilitate removal of retaining ring 70 telescopically set within seat means 25. Seat means 25 includes top side 26, bottom side 27, outer peripheral edge 28, inner peripheral edge 29 defining waste aperture 30, front end 31, and back side 32 (shown in FIGS. 3 and 5). Leg means 35 and 36 are operably attached to seat means 25 by leg relocating means, such as leg relocating means 45 shown in FIGS. 3 and 6, and include a top end, such as top end 37, a bottom end 38, a rear end 39, (shown in FIG. 5), an inner surface, such as inner surface 40, a leg means 35 and an outer surface 41. Seat means 25 includes first recessed portion 100 (which operably accepts the receipt of waste retention means 60) and, a second recessed portion 101 (which operably accepts the receipt of retaining ring 70), as shown in FIG. 11.

Figure 8:
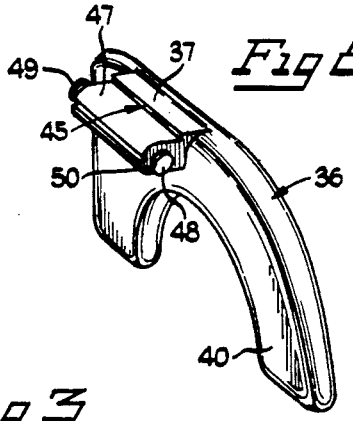
FIG. 8 of the drawings is a perspective view of one of the leg means, showing, in particular, the second section of the hinge element, including a tab-receiving notch region, as well as the shaft element positioned therewithin.

Leg relocating means, such as leg relocating means 45, are shown in FIGS. 3, 6 and 8, as including hinge elements each having a first section, such as first section 46, operably attached adjacent outer peripheral edge 28 of seat means 25, and a second section 47 (and 47') operably attached adjacent top end 37 (and 37') of each of the leg means 35 and 36 respectively. Second section 47 includes shaft element, such as shaft element 50, which has a first protruding end 48 and a second protruding end 49. When operably engaged, first section 46 and second section 47 facilitate pivotal movement of leg means 35 and 36 from a fully deployed position, as shown in FIG. 1 and FIG. 3, to a fully retracted position as shown in FIG. 2.

Restraining means, such as restraining means 51 through 57, are shown in FIGS. 1–7. These restraining means comprise restraining posts, such as restraining posts 51 through 54, restraining non-slip pads, such as restraining pad 55 and 55', all of which are operably attached to the outer surfaces, such as outer surface 41, of leg means 35 and 36, and, restraining bottom posts, such as bottom posts 56 and 57, which are positioned on the bottom ends, such as bottom end 38, of leg means 35 and 36. In operation, restraining posts 51 through 54 will be operably positioned adjacent the inner peripheral edge of a supporting toilet seat 250 of a conventional toilet 200 when leg means 35 and 36 are in a fully retracted position, as shown in FIG. 2 to restrain apparatus 20 in position. Additionally, when the leg means are in such a position, a portion, such as portions 55*a*, 55*b* and 55*c*, 55*d*, of the non-slip restraining pad, such as pads 55 and 55', respectively, will be in contact with a portion of the top surface of the conventional supporting toilet seat. Accordingly, while restraining posts 51 through 54 serve to facilitate aligned positioning of articulable training toilet apparatus 20 when used in cooperation with a conventional toilet, restraining pads, such as pads 55 and 55', serve to preclude inadvertent slippage of apparatus 20 which may otherwise result when the weight placed upon apparatus 20 is shifted during such use.

Figure 4:
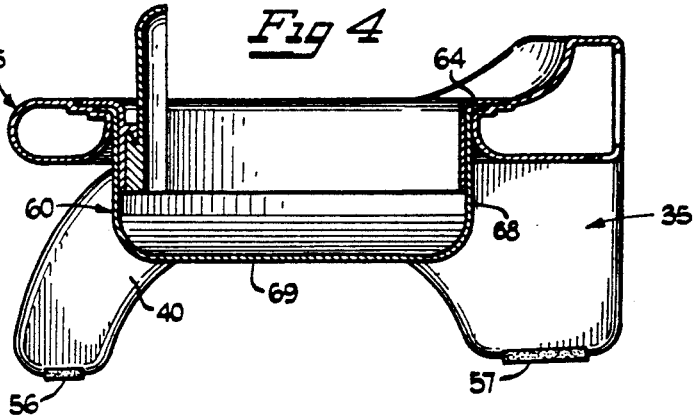
FIG. 4 of the drawings is a cross-sectional side view of the articulable training toilet apparatus, taken along lines 4—4 of FIG. 3, and looking in the direction of the arrows, showing, in particular, the relative positioning of the canister and retaining ring as operably seated in the recessed, flange portion of the seat means, as well as the non-skid feet located at the bottom end of the leg means for precluding inadvertent slippage of the apparatus when used as a stand alone toilet.

Furthermore, restraining bottom posts, such as posts 56 and 57, as shown in FIG. 4, serve to preclude inadvertent slippage of apparatus 20 when leg means 35 and 36 are in their fully deployed position (FIG. 1), and when apparatus 20 is being used as a stand alone toilet. Preferably, restraining means 51 through 57 may be constructed from a rubber material, although other materials having relatively high co-efficients of friction are also contemplated. Additionally, although restraining posts 51 through 54 and 56 through 57 are shown in FIG. 3 as being partially embedded within the leg means, other methods of attachment, such as by adhesion, are likewise contemplated.

Waste retention means 60, as shown in FIGS. 1, 4, 5, 10 and 11, which comprises a substantially rigid canister 68, forms interior waste region 61, and includes interior surface 62 surrounding the interior region, external surface 63, top peripheral edge 64 which defines aperture 65 (FIG. 10), and a bottom end 69 which seals the bottom of interior region 61. When operably engaged within seat means 25, canister 68 is telescopically received within aperture 30 of seat means 25, until top peripheral edge 64 of canister 68 is seated on first recessed portion 100 (FIG. 11). Accordingly, when operably positioned, canister 68 accepts and retains human waste through aperture 65 either directly, or as lined with a disposable liner.

Figure 10:
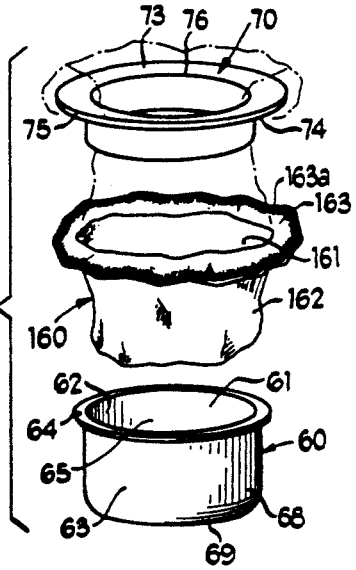
FIG. 10 of the drawings is an exploded perspective view of the canister, disposable liner and retaining ring, showing, in particular, the operable positioning and attachment of the disposable liner, through the aperture of the retaining ring and over the outer peripheral edge of same, prior to engagement with the upper periphery of the canister.
Figure 9:
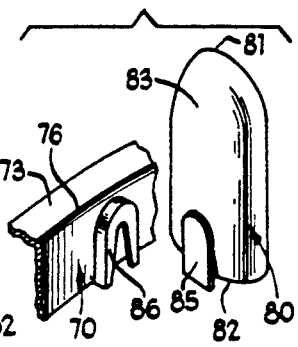
FIG. 9 of the drawings is a perspective view of the downwardly releasable mounting means on the retaining member and urine deflector, showing, in particular, the deflector acceptance slot positioned on the inner surface of the retaining ring, and the male attachment clip positioned on the back side of the urine deflector for telescopic, downwardly slideable cooperation therebetween.
Figure 12:
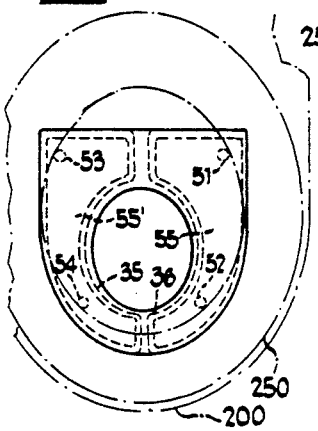
FIG. 12 of the drawings is a top plan view of the articulable training toilet apparatus supported in operable contact with a conventional toilet seat, showing, in particular, and in dashed lines, the position of a conventional toilet seat relative to Applicants' articulable training toilet apparatus, the aligned secured cooperation of the leg means with the conventional toilet seat, the restraining posts cooperating with the interior periphery of the conventional toilet seat and the non-slip surface of the leg means cooperating with the upper surface of the conventional toilet seat.

Retaining ring 70, is shown in FIGS. 1, 9 and 10, as including top side 73, bottom side 74, outer peripheral edge 75, inner peripheral edge 76, and deflector acceptance slot 86 which telescopically receives urine deflector 80. Retaining ring 70 is removably attached to seat means 25 by lowering bottom side 74 of retaining ring 70 into telescopic cooperation with second recessed portion 101, as shown in FIG. 2. If canister 68 is also utilized, bottom side 74 of retaining ring 70 will be positioned adjacent the top peripheral edge 64 of canister 68. Such an orientation will result in top side 73 being positioned in substantially co-planar relationship with top side 26 of seat means 25, as shown in FIG. 1.

Urine deflector 80, as shown in FIGS. 1 and 9, includes top end 81, bottom end 82, curved back side 83, an equivalently curved front side, and male attachment clip 85 operably attached to back side 83. As urine deflector 80 is not required to enable basic use of apparatus 20, it is included as an optional, slideable attachment piece. Accordingly, when such use is desired, such as when a male infant is using apparatus 20, assembly is accomplished by simply slideably engaging male attachment clip 85 with deflector acceptance slot 86 of retaining ring 70, telescopically sliding deflector 80 upwardly so that top end 81 extends above and beyond top side 73 of retaining ring 70, and, in turn, above and beyond top side 26 of seat means 25 when retaining ring 70 is operably attached thereto. Such upwardly telescopic attachment of urine deflector 80 specifically provides the advantage of reducing the likelihood of injury to a child, should the child accidentally place his or her weight on the top end 81 of urine deflector 80. If such weight is exerted upon top end 81 of urine deflector 80, it would simply slidably, downwardly prompt the release of the urine deflector from engagement with the deflector acceptance slot—forcing deflector 80 through the waste release aperture 30.

Figure 7:
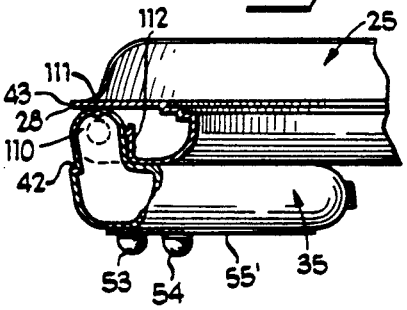
FIG. 7 of the drawings is a front, partially sectional view of the articulable training toilet apparatus showing, in particular, the operable positioning of the leg means in its fully retracted position, and showing the positioning of the retraining posts on the outer surface of the legs means which are used for aligned securement with the supporting toilet seat of a conventional toilet.

Locking means 110 and 120, which serve to preclude over deployment of leg means 35 and 36 as well as inadvertent collapsing of same, are shown in FIGS. 6 and 7. Specifically, locking means 110 includes notched portions, such as notched portion 111, which are integrally formed in the inner surface 40, of leg means, such as leg means 35, and a locking tab 112 having detent 113 formed into the outer peripheral edge 28 of seat means 25. Accordingly, when leg means, such as leg means 35, are pivoted into their fully deployed position, as shown in FIGS. 1 and 6, detent 113 of locking tab 112 will springedly engage with respective, aligned notched portion 111. Once fully engaged, such intercooperation between notch 111 and detent 113 will serve to inadvertently preclude collapsing of leg means 35 and 36 from their fully deployed position towards their retracted position.

Inadvertent collapsibility of leg means 35 and 36 towards their retracted position is even further prevented as the result of the angularly, outwardly-flared orientation of legs 35 and 36 relative to seat means 25, as shown in FIG. 6. Both leg means 35 and 36 retain their substantially outwardly flared position relative to outer peripheral edge 28 of seat means 25 when the leg means are in their fully deployed position, to further preclude inadvertent retraction of the legs when weight of a user is applied to the seat means.

While locking means 110 and outward flaring of the leg means serve to preclude inadvertent inward collapse of leg means 35 and 36 towards their retracted position, locking means 120 serves to preclude leg means 35 and 36 from being over extended outwardly from their deployed position. Specifically, locking means 120 includes recessed portion, such as recessed portion 42, as shown in FIG. 7, of top inner surface 40 of leg means 35, abutting in operable engagement with portion 43 of upper-outer peripheral edge 28 of seat means 25, as shown in FIGS. 6 and 7. Accordingly, when leg means 35 is in its fully deployed position, over extension will be precluded from the reinforced interference caused by abutment of leg means portion 42 with portion 43 of seat means 25.

Figure 5:
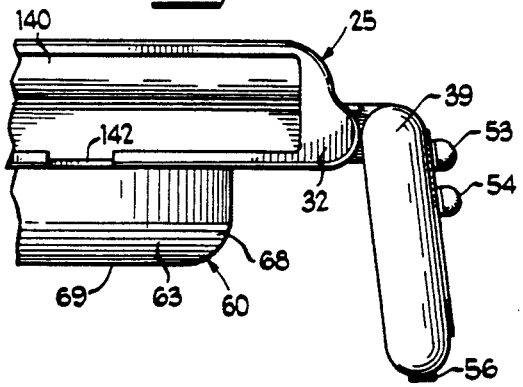
FIG. 5 of the drawings is a partial rear view, of the articulable training toilet apparatus showing, in particular, the liner storage means used for releasably maintaining disposable liners therewithin, the grooved section for facilitating removal of the liners, as well as the operable positioning of the restraining posts and restraining pad on the outer surface of the leg means, and the orientation of a fully deployed leg.

Liner storage means 140, which comprises a hollowed out section in back side 32 of apparatus 20, is shown in FIGS. 3 and 5. Liner storage means 140 is used to releasably maintain package(s) of disposable liners therein, containing disposable liners such as disposable liner 160, as shown in FIG. 10, which may alternatively be used in cooperation with articulable training toilet apparatus 20, if desired. Also shown in FIGS. 3 and 5 is grooved portion 142 which is used to enable a person's finger to be inserted into storage area 140 so as to facilitate ease in removal of a container of such liners.

Disposable liner 160, as shown in FIGS. 10 and 11, may alternatively be used to collect human waste which passes through aperture 30 of seat means 25, and includes inner surface 161, outer surface 162 and top edge 163. Such a liner includes an elastic member 163*a* at top edge 163 to facilitate secured attachment of the liner means to either retaining member 70 or canister 68. When liner means 160 is to be used, retaining ring 70 will usually be used also. To reduce the likelihood of human waste coming into contact with any portion of articulable training toilet apparatus 20, and more specifically, coming into contact with retaining ring 70 or canister 68, liner means 160 is ideally inserted through adjacent inner peripheral edge 76 of retaining ring 70, and then positioned elastically over and around outer peripheral edge 75 of retaining ring 70, as shown in FIG. 11. Top edge 163 of liner 160 may be sandwiched between the outer peripheral top edge of retaining ring 70 and the inner peripheral top edge of canister 68, as shown in FIG. 11. While such attachment is recommended with, or without the use of canister 68, other methods of attachment are also contemplated.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. An articulable training toilet apparatus for use by a child in cooperation with a supporting toilet seat having an interior apertured periphery, of a conventional toilet, and which can alternatively be used as a stand alone toilet on independent ground and table surfaces, said articulable training toilet apparatus comprising:

seat means for providing a platform upon which a child may sit, said seat means including a top side, a bottom side, an outer peripheral edge, and an inner peripheral edge which defines an aperture for the passage of human waste therethrough;

leg means having a top end operably attached to said seat means and a bottom distal end unattached to said seat means for providing elevated support to said seat means when said articulable training toilet apparatus is utilized as said stand alone toilet upon said independent surfaces, said leg means including leg relocating means operably attached between said top end of said leg means and said seat means for alternatively deploying and retracting said leg means from operable contact with said independent surfaces, said leg relocating means comprising one or more hinge elements operably located between said leg means and said seat means, said one or more hinge elements including self-actuated locking means for releasably securing said leg means into their deployed position, said self-actuated locking means accommodating locking engagement between said deployed leg means and said seat means without further manual deployment of independent bracing members, said articulable training toilet apparatus being usable as a stand alone toilet when said leg means are in said deployed position with said bottom distal end of said leg means operably contacting said independent surfaces to elevate same, and alternatively usable in operable cooperation with said supporting toilet seat of a conventional toilet when said leg means are in said retracted position, while said toilet seat supports said articulable training toilet apparatus through operable contact with and support of said retracted leg means;

said leg means being configured so as to preclude obstruction of said waste passage aperture in said seat means when said leg means are in either one of said alternative deployed and retracted positions; and waste retention means operably and removably attachable directly to said seat means, at least a portion of said waste retention means being operably positioned within said waste passage aperture defined by said inner peripheral edge of said seat means, for collecting human waste released by a child using said articulable training toilet apparatus.

2. The invention according to claim 1 in which said leg means further include a rear end and a front end, and an inner surface and an outer surface;

said leg means having said outer surface of same in operable contact with said supporting toilet seat of said conventional toilet, when said leg means are in said retracted position, for usable cooperation of said apparatus with said conventional toilet.

3. The invention according to claim 2 in which said leg means further include restraining means operably attached to said leg means for facilitating aligned secured cooperation of said leg means with said supporting toilet seat of said conventional toilet when said articulable training toilet apparatus is used in operable cooperation with said conventional toilet, and further serving to preclude inadvertent slippage of said articulable training toilet apparatus when used in said operable cooperation with said conventional toilet.

4. The invention according to claim 3 in which said restraining means comprises one or more restraining posts operably attached to said outer surface of said leg means;

each of said one or more restraining posts cooperating with the interior apertured periphery of said conventional toilet seat to restrain the position of said apparatus supported thereon.

5. The invention according to claim 3 in which said restraining means comprises a substantially non-slip surface operably attached to said outer surface of said leg means;

said non-slip surface co-operating with the upper surface of said conventional toilet seat to restrain the position of said apparatus supported thereon.

6. The invention according to claim 2 in which said leg relocating means comprises one or more hinge elements between said leg means and said seat means, each hinge element having a first section integrally positioned adjacent said outer peripheral edge of said seat means, and a second section positioned adjacent to said top end of said leg means, with a shaft element operably and pivotably positioned between said first and second sections, to, in turn, facilitate pivotal movement of said leg means relative to said seat means, towards relocation between said deployed and retracted positions.

7. The invention according to claim 6 in which said one or more hinge elements further include locking means for releasably securing said leg means into their said deployed position so as to preclude said leg means from collapsing inwardly toward their said retracted position when an individual is using said articulable training toilet apparatus as said stand alone toilet, as well as to preclude said leg means from collapsing outwardly during said use by an individual.

8. The invention according to claim 7 in which said locking means comprises said leg means being deployable to a substantially outwardly flared position relative to the outer peripheral edge of said seat means, when said leg means have been positioned in said deployed position, so as to further preclude the inadvertent inward collapse of said leg means when weight is applied to said articulable training toilet apparatus when used as said stand alone toilet.

9. The invention according to claim 6 in which said leg means comprises two leg members:

the inner surfaces of each of said two leg members being substantially juxtaposed and parallel to said bottom side of said seat means when said leg members are in said retracted position so as to facilitate substantially horizontal supporting cooperation of said outer surfaces of said leg members by the substantially horizontal supporting toilet seat of said conventional toilet;

each of said leg members being angled outwardly relative to the bottom side of said seat means when said two leg members are in said deployed position so as to operably elevate said bottom side of said seat means above and over said independent surface upon which said articulable training toilet apparatus may be resting, when said apparatus is alternatively used as said stand alone toilet.

10. The invention according to claim 1 in which said waste retention means comprises a substantially rigid canister having an open interior region, an interior surface surrounding said interior region, an external surface, a top peripheral edge defining an aperture, and a bottom end sealing the bottom of said open interior region, said waste retention means being operably and telescopically received at said inner peripheral edge of said seat means for alternative affixation and removal therefrom.

11. The invention according to claim 10 in which the articulable training toilet apparatus further includes disposable liner means operably positionable within said interior region of said canister for precluding said human waste from physically contacting the interior region of said canister, said disposable liner means having a substantially elastomeric top portion so as to enable a stretch fit of said disposable liner means over and about said top peripheral edge of said canister.

12. The invention according to claim 11 in which the articulable training toilet apparatus further includes liner retaining means removably attachable to the upper interior edge of said canister, for providing additional securement of said disposable liner means within said canister.

13. The invention according to claim 12 in which said articulable training toilet apparatus further includes liner retainer removal means integrally positioned within the top inner peripheral edge of said seat means, and adjacent said liner retaining means, for facilitating the removal of said liner retaining means from its position at the upper interior edge of said canister.

14. The invention according to claim 13 in which said liner retainer removal means comprises a grooved finger insertion region immediately proximate both the inner peripheral edge at the top of said seat means and the outer edge of said liner retaining means.

15. The invention according to claim 12 in which said articulable training toilet apparatus further includes urine deflector means operably attachable adjacent the forwardmost position of said human waste aperture of said seat means, for preventing the inadverdent spray of urine during use of said articulable training toilet apparatus.

16. The invention according to claim 15 in which said urine deflector means is slidably and telescopically removable from said liner retaining means towards said bottom side of said seat means, so as to preclude injury which may otherwise occur to an individual contacting said urine deflector means from above.

17. The invention according to claim 1 in which the waste retention means further includes:

disposable liner means for acceptance of said human waste passing through said aperture in said seat means; and retaining means removably attached to said seat means for operable cooperation with, and securement of, said disposable liner means.

18. The invention according to claim 1 in which said articulable training toilet apparatus further includes a back side, said back side describing liner storage means operably positioned therewithin for releasably maintaining disposable toilet liners prior to actual use.

19. The invention according to claim 18 in which said liner storage means further includes a grooved slot for acceptance of a person's finger to facilitate removal of said disposable toilet liners.

20. An articulable training toilet apparatus for use by a child in cooperation with a supporting toilet seat of a conventional toilet, and which can alternatively be used as a stand alone toilet on independent ground and table surfaces, said articulable training toilet apparatus comprising:

seat means for providing a platform upon which a child may sit, said seat means including a top side, a bottom side, an outer peripheral edge, and an inner peripheral edge which defines an aperture for the passage of human waste there through;

leg means operably attached to said seat means for providing elevated support to said seat means when said articulable training toilet apparatus is utilized as said stand alone toilet upon said independent surfaces, said leg means including leg relocating means for alternatively deploying and retracting said leg means from operable contact with said independent surfaces;

said articulable training toilet apparatus being usable as a stand alone toilet when said leg means are in said deployed position with said leg means operably contacting said independent surfaces to elevate same, and alternatively usable in operable cooperation with said supporting toilet seat of a conventional toilet when said leg means are in said retracted position, while said toilet seat supports said articulable training toilet apparatus through operable contact with and support of said retracted leg means;

said leg means being configured so as to preclude obstruction of said waste passage aperture in said seat means when said leg means are in either one of said alternative deployed and retracted positions, said leg means having a top end and a bottom end, a rear end and a front end, and an inner surface and an outer surface;

said leg means further having said outer surface of same in operable contact with said supporting toilet seat of said conventional toilet, when said leg means are in said retracted position, for usable cooperation of said apparatus with said conventional toilet;

said leg relocating means comprising one or more hinge elements between said leg means and said seat means, each said hinge element having a first section integrally positioned adjacent said outer peripheral edge of said seat means, and a second section positioned adjacent to said top end of said leg means, with a shaft element operably and pivotably positioned therebetween said first and second sections, to, in turn, facilitate pivotal movement of said leg means relative to said seat means, towards relocation between said deployed and retracted positions, said one or more hinge elements further including locking means for releasably securing said leg means into their said deployed position so as to preclude said leg means from collapsing inwardly toward their said retracted position when an individual is using said articulable training toilet apparatus as said stand alone toilet, as well as to preclude said leg means from collapsing outwardly during said use by an individual, said locking means comprising one or more notches integrally formed in the inner surface of said leg means, and a locking tab element formed into the outer peripheral edge of said seat means, said locking tab element springedly engaging with said one or more notches upon positioning of said leg means in said deployed position relative to said seat means to substantially restrain said leg means in said deployed position, towards precluding the inward and outward collapse of same.

21. An articulable training toilet apparatus for use by a child in cooperation with a supporting toilet seat of a conventional toilet, and which can alternatively be used as a stand alone toilet on independent ground and table surfaces, said articulable training toilet apparatus comprising:

seat means for providing a platform upon which a child may sit, said seat means including a top side, a bottom side, an outer peripheral edge, and an inner peripheral edge which defines an aperture for the passage of human waste there through;

leg means operably attached to said seat means for providing elevated support to said seat means when said articulable training toilet apparatus is utilized as said stand alone toilet upon said independent surfaces, said leg means including leg relocating means for alternatively deploying and retracting said leg means from operable contact with said independent surfaces;

said articulable training toilet apparatus being usable as a stand alone toilet when said leg means are in said deployed position with said leg means operably contacting said independent surfaces to elevate same, and alternatively usable in operable cooperation with said supporting toilet seat of a conventional toilet when said leg means are in said retracted position, while said toilet seat supports said articulable training toilet apparatus through operable contact with and support of said retracted leg means;

said leg means being configured so as to preclude obstruction of said waste passage aperture in said seat means when said leg means are in either one of said alternative deployed and retracted positions, said leg means having a top end and a bottom end, a rear end and a front end, and an inner surface and an outer surface;

said leg means further having said outer surface of same in operable contact with said supporting toilet seat of said conventional toilet, when said leg means are in said retracted position, for usable cooperation of said apparatus with said conventional toilet;

said leg relocating means comprising one or more hinge elements between said leg means and said seat means, each said hinge element having a first section integrally positioned adjacent said outer peripheral edge of said seat means, and a second section positioned adjacent to said top end of said leg means, with a shaft element operably and pivotably positioned therebetween said first and second sections, to, in turn, facilitate pivotal movement of said leg means relative to said seat means, towards relocation between said deployed and retracted positions, said one or more hinge elements further including locking means for releasably securing said leg means into their said deployed position so as to preclude said leg means from collapsing inwardly toward their said retracted position when an individual is using said articulable training toilet apparatus as said stand alone toilet, as well as to preclude said leg means from collapsing outwardly during said use by an individual, said locking means comprising a portion of said outer peripheral edge of the top side of said seat means directly abutting with a portion of said inner surface of said leg means, proximate said top end of said leg means, when said leg means are in said deployed position so as to further preclude the inadvertent outward collapse of said leg means when weight is applied to said articulable training toilet apparatus when used as said stand alone toilet.

* * * * *